US009852845B2

(12) United States Patent
Imanishi et al.

(10) Patent No.: US 9,852,845 B2
(45) Date of Patent: Dec. 26, 2017

(54) AIR CORE COIL FITTING APPARATUS

(71) Applicant: SHT Corporation Limited, Izumisano-shi, Osaka (JP)

(72) Inventors: Tsunetsugu Imanishi, Izumisano (JP); Masafumi Inoue, Izumisano (JP); Yasuomi Takahashi, Izumisano (JP); Hitoshi Yoshimori, Izumisano (JP)

(73) Assignee: SHT Corporation Limited, Osaka (JP)

( * ) Notice: Subject to any disclaimer, the term of this patent is extended or adjusted under 35 U.S.C. 154(b) by 275 days.

(21) Appl. No.: 14/949,270

(22) Filed: Nov. 23, 2015

(65) Prior Publication Data

US 2016/0148753 A1 May 26, 2016

(30) Foreign Application Priority Data

Nov. 25, 2014 (JP) ..... 2014-237848

(51) Int. Cl.
*H01F 41/02* (2006.01)
*H01F 17/06* (2006.01)
(Continued)

(52) U.S. Cl.
CPC ..... *H01F 41/0246* (2013.01); *H01F 17/062* (2013.01); *H01F 27/2895* (2013.01);
(Continued)

(58) Field of Classification Search
CPC .... B21F 3/02; B21F 3/04; H01F 41/02; H01F 41/0246; H01F 17/062; H01F 27/2895;
(Continued)

(56) References Cited

U.S. PATENT DOCUMENTS 3,324,536 A * 6/1967 Hill ..... H02K 15/068 29/606
3,481,372 A * 12/1969 Tyson ..... B21F 3/04 140/92.1
(Continued)

FOREIGN PATENT DOCUMENTS

JP H04 17314 A 1/1992
JP H07 263261 A 10/1995
(Continued)

OTHER PUBLICATIONS

Japanese Patent Office, "Office Action" from counterpart JP Application No. 2014-237848 (no English language translation available), 3 pp., Sep. 13, 2016.
(Continued)

*Primary Examiner* — Carl Arbes
(74) *Attorney, Agent, or Firm* — Eckert Seamans; Grant Coffield

(57) ABSTRACT

In order to provide an air core coil fitting apparatus that can automatically fit an air core coil onto a core, an air core coil fitting apparatus includes a holding member, a coil fitting rod, a rod driving member, a pushing member, and a sending member. The holding member holds a core main body that is formed in a ring shape, has a gap extending through the core main body from an inner circumferential face to an outer circumferential face thereof, and allows an air core coil wound in advance to be fitted onto the core main body from one end thereof. On the coil fitting rod, the air core coil that is to be fitted onto the core main body held by the holding member is fitted. The rod driving member brings a front end of the coil fitting rod close to or into contact with the one end of the core main body held by the holding member. The pushing member pushes the air core coil fitted on the coil fitting rod, toward the one end of the core main body. The sending member is disposed at a circumferential edge of the
(Continued)

core main body held by the holding member, and pulls the air core coil pushed by the pushing member and fitted onto the core main body, toward another end of the core main body.

14 Claims, 8 Drawing Sheets

(51) Int. Cl.
*H01F 27/28* (2006.01)
*H01F 27/30* (2006.01)
*H01F 41/082* (2016.01)

(52) U.S. Cl.
CPC ..... *H01F 27/306* (2013.01); *H01F 41/02* (2013.01); *H01F 41/082* (2016.01)

(58) Field of Classification Search
CPC ..... H01F 27/306; H01F 41/082; H02K 15/04; H02K 15/06; H02K 15/05
See application file for complete search history.

(56) References Cited

U.S. PATENT DOCUMENTS 3,602,972 A * 9/1971 Droll ..... H02K 15/068 29/732
3,624,891 A * 12/1971 Droll ..... H02K 15/068 29/732
3,691,606 A * 9/1972 Muskulus ..... H02K 15/068 29/732
3,828,830 A * 8/1974 Hill ..... H02K 15/068 140/1
4,186,478 A * 2/1980 Hamane ..... H02K 15/068 29/596
2003/0115742 A1 6/2003 Cattaneo
2005/0001709 A1 1/2005 Pais et al.
2008/0201935 A1* 8/2008 Nakayama ..... H02K 15/045 29/596
2015/0074985 A1* 3/2015 Ohno ..... H02K 15/064 29/596
2015/0078875 A1* 3/2015 Saito ..... H02K 15/04 414/751.1

FOREIGN PATENT DOCUMENTS

JP 2001-210523 A 8/2001
JP 2004 327461 A 11/2004
JP 2011-135091 A 7/2011

OTHER PUBLICATIONS

European Patent Office, "Extended European Search Report", from counterpart EP Application No. 15 19 5860.0, 10 pp., May 6, 2016.

* cited by examiner

AIR CORE COIL FITTING APPARATUS

BACKGROUND OF THE INVENTION

1. Field of the Invention

The present invention relates to an apparatus for manufacturing a coil device installed in a rectifier circuit in AC equipment such as a power circuit or an inverter, a noise suppression circuit, a resonance circuit, and the like, and more specifically relates to an air core coil fitting apparatus for fitting an air core coil onto a core.

2. Description of Related Art

Coil devices such as choke coils are formed by attaching a wound wire around a core made of a magnetic material. In order to easily attach a wound wire to a core, the core has a gap extending through the core in the radial direction. An air core coil wound in advance is fitted using this gap onto the core (see FIGS. 1 and 2 of JP 2011-135091A, for example), after which the gap is filled with a magnetic or non-magnetic filling member (see FIG. 9 of JP 2011-135091A, for example).

The operation that fits air core coils onto cores is manually performed. Since gap dimensions are determined so as to be preferable for magnetic circuit designs such as inductance values or magnetic saturation characteristics, it is not possible to obtain a design that ensures gap dimensions necessary for fitting of coils. Accordingly, in most cases, air core coils have to be fitted through narrow gaps, resulting in problems that the qualities and the numbers of coil devices manufactured vary depending on the skill of operators, i.e., problems such as deformation in which part of the air core coils is tensioned and deformed, friction on the insulating coat surfaces, or variation in the output due to poor efficiency in the fitting operation.

SUMMARY OF THE INVENTION

It is an object of the present invention to solve the above-described problems by providing an air core coil fitting apparatus that can automatically fit air core coils onto cores.

The present invention is directed to an air core coil fitting apparatus, including:

a holding member adopted to hold a core main body that is formed in a ring shape, has a gap extending through the core main body from an inner circumferential face to an outer circumferential face thereof, and allows an air core coil wound in advance to be fitted onto the core main body from one end thereof;

a coil fitting rod on which the air core coil that is to be fitted onto the core main body held by the holding member is fitted;

a rod driving member adopted to bring a front end of the coil fitting rod close to or into contact with the one end of the core main body held by the holding member;

a pushing member adopted to push the air core coil fitted on the coil fitting rod, toward the one end of the core main body, in a state in which the front end of the coil fitting rod is close to or in contact with the one end of the core main body; and a sending member adopted to pull the air core coil pushed by the pushing member and fitted onto the core main body, toward another end of the core main body, the sending member being disposed at a circumferential edge of the core main body held by the holding member.

It is possible that the rod driving member swings the coil fitting rod, thereby bringing the front end of the coil fitting rod close to or into contact with the one end of the core main body held by the holding member.

It is possible that the rod driving member moves the coil fitting rod in a direction along a longitudinal direction of the coil fitting rod, thereby bringing the front end of the coil fitting rod close to or into contact with the one end of the core main body held by the holding member.

It is possible that the sending member is disposed close to an outer circumferential edge of the core main body held by the holding member, and includes a plurality of catch pieces that can project toward and withdraw from the outer circumferential edge and a moving member that moves the catch pieces from the one end to the other end of the core main body.

It is possible that the pushing member pushes the air core coil toward the core main body at least to a position facing the plurality of catch pieces, and the sending member has a biasing member adopted to bias the plurality of catch pieces toward the outer circumferential edge, thereby bringing the plurality of catch pieces into contact with the air core coil.

It is possible that each of the plurality of catch pieces has a biasing face for biasing the air core coil in contact with the catch piece in a direction along the outer circumference during movement from the one end to the other end of the core main body.

It is possible that the moving member has a circular arc member that is disposed close to the outer circumferential edge of the core main body held by the holding member and travels from the one end to the other end of the core main body.

It is possible that the coil fitting rod includes, at the front end thereof, an engagement member that can be engaged with the one end of the core main body held by the holding member.

It is possible that the core main body includes a core made of a magnetic material and an insulating coating member that coats an outer circumference of the core, and the coating member includes an engagement target member that can be engaged with the engagement member.

It is possible that the core main body includes a core made of a magnetic material and an insulating coating member that coats an outer circumference of the core, and the coating member includes a positioning member projecting from an inner circumference at the other end of the core main body, and the holding member includes a chuck for holding the positioning member.

It is possible that the core main body includes a core made of a magnetic material and an insulating coating member that coats an outer circumference of the core, and the coating member includes a rotation preventing member projecting from an outer circumference at the other end of the core main body, and the holding member includes a pressing member for biasing the rotation preventing member in an orientation opposite to a fitting direction of the air core coil.

It is possible that the core is a dust compact, and the coating member is formed by performing insert-molding with an insulating resin material.

The air core coil fitting apparatus of the present invention can automatically fit an air core coil onto a core main body. Furthermore, since the sending member is used, the air core coil can be pulled along the circumferential edge of the core main body, and the air core coil that is being fitted from one end of the core main body is fitted to another end of the core main body without being stuck at the middle of the core main body.

DETAILED DESCRIPTION OF THE INVENTION

Hereinafter, an air core coil fitting apparatus 10 according to an embodiment of the present invention will be described with reference to the drawings.

Figure 1:
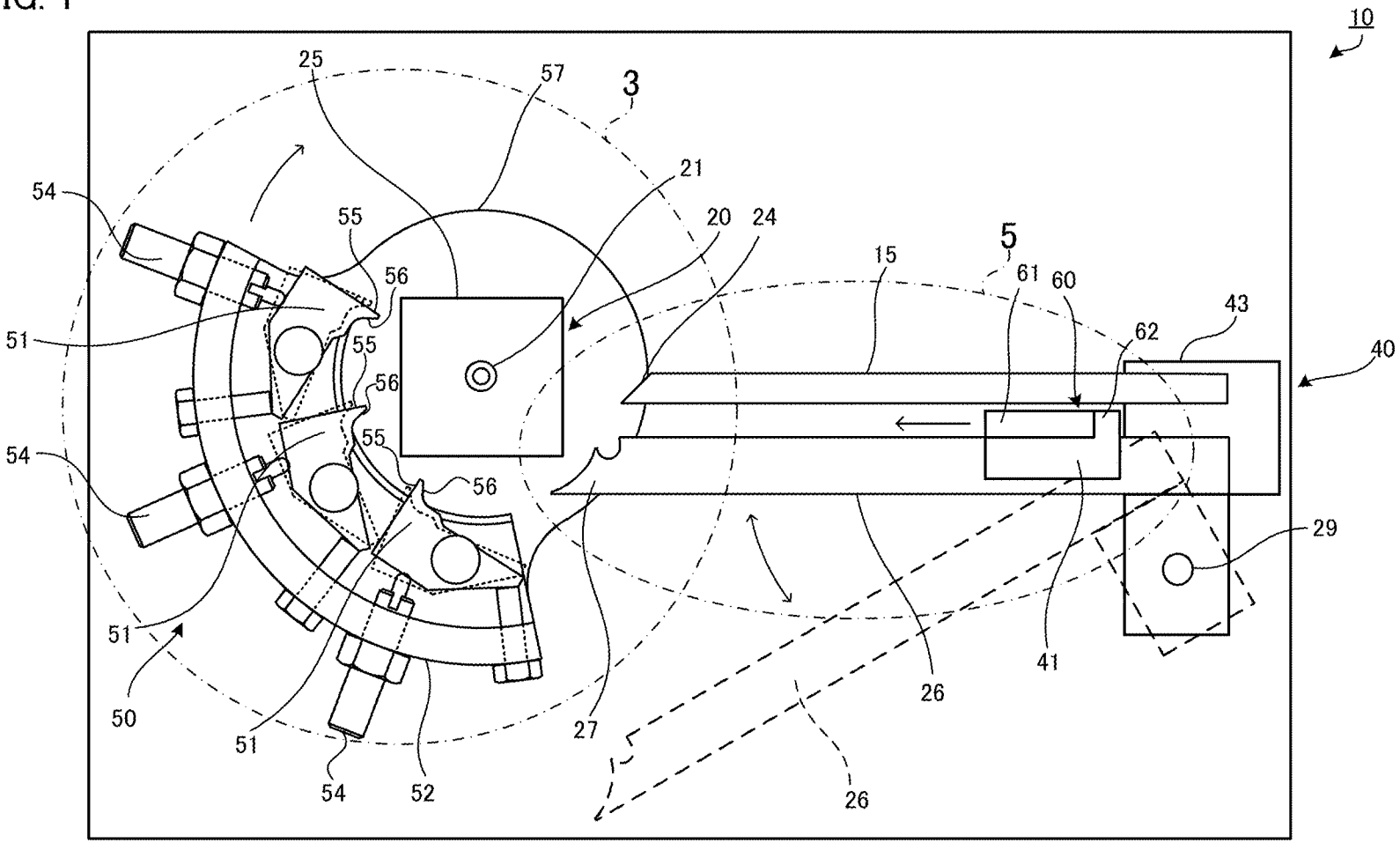
FIG. 1 is a plan view showing a schematic configuration of an air core coil fitting apparatus according to an embodiment of the present invention.
Figure 2:
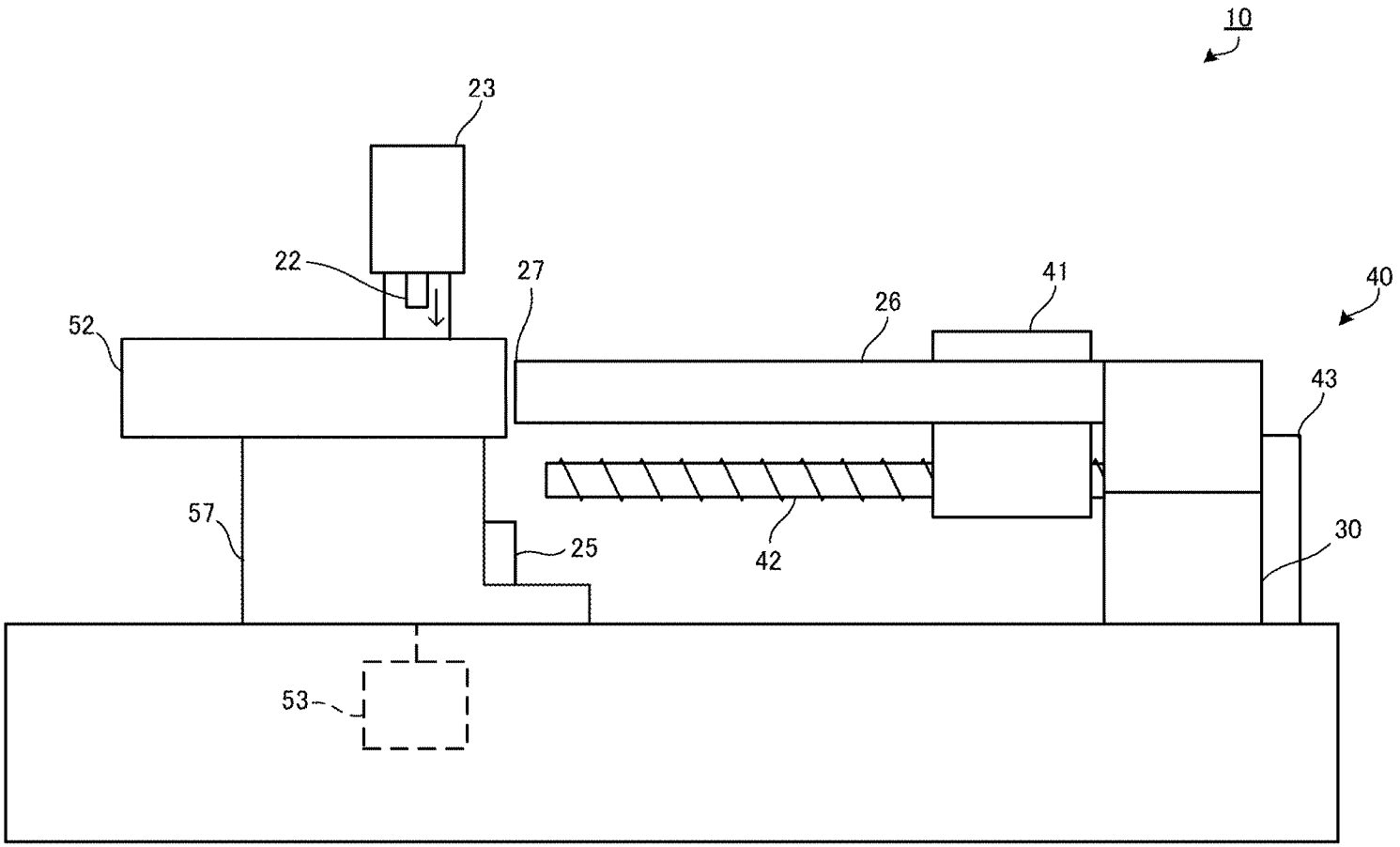
FIG. 2 is a side view showing a schematic configuration of the air core coil fitting apparatus according to the embodiment of the present invention.
Figure 3:
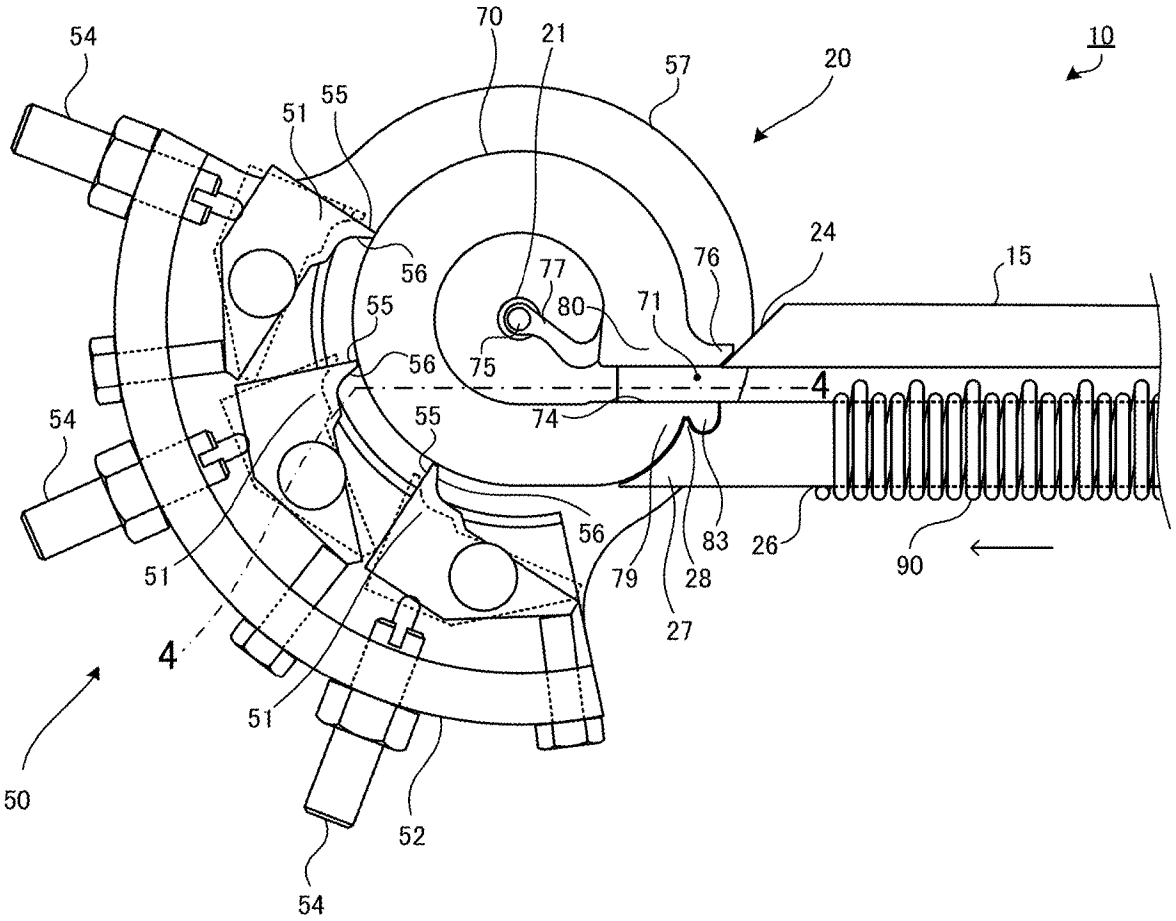
FIG. 3 is an enlarged plan view of an encircled portion 3 in FIG. 1, showing a state in which a core main body and an air core coil are attached.

FIGS. 1 and 2 are a plan view and a side view showing a schematic configuration of the air core coil fitting apparatus 10. FIG. 3 is an enlarged plan view of an encircled portion 3 in FIG. 1, showing a state in which a core main body 70 and an air core coil 90 are attached. The air core coil fitting apparatus 10 is an apparatus in which the air core coil 90 wound in advance is fitted onto the core main body 70 having a gap 71 as shown in FIG. 3, after which a filling member 85 is fitted into the gap 71 (see FIG. 7).

As the overall configuration, as shown in FIGS. 1 to 3, the air core coil fitting apparatus 10 includes a holding member 20 adopted to hold the core main body 70, a coil fitting rod 26 on which the air core coil 90 is fitted, a rod driving member 30 adopted to bring a front end of the coil fitting rod 26 close to or into contact with the core main body 70, a pushing member 40 adopted to push the air core coil 90 toward the core main body 70, a sending member 50 adopted to pull the air core coil 90 onto the core main body 70, and a filling member fitting member 60 adopted to fit the filling member 85 into the gap 71. Note that, in FIG. 1, part of the configuration of the holding member 20 is not shown.

Figure 7:
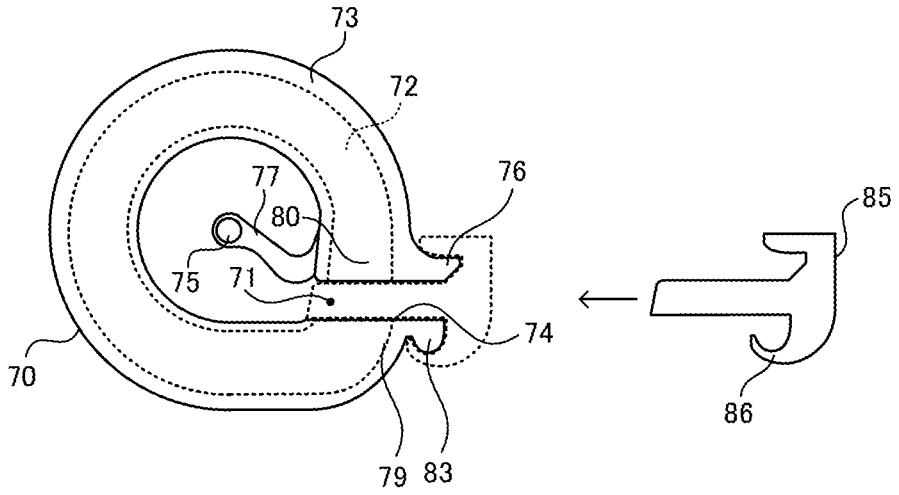
FIG. 7 is a plan view showing an appearance of the core main body that is to be attached to the air core coil fitting apparatus according to the embodiment of the present invention.

As shown in FIG. 7, the core main body 70 onto which the air core coil 90 is to be fitted by the air core coil fitting apparatus 10 of the present invention has the gap 71 extending through the core main body 70 from the inner circumferential face to the outer circumferential face. The core main body 70 may be formed by coating an outer circumference of a core 72 made of a magnetic material, with an insulating resin 73. FIG. 7 is a plan view showing an appearance of the core main body 70 that is to be attached to the air core coil fitting apparatus 10.

Examples of the magnetic substance used in the core 72 include a laminated magnetic core obtained by laminating or winding a thin plate made of silicon steel (hereinafter, referred to as a silicon steel core), a dust compact obtained by pressure-molding a powder such as an iron-based, an iron-silicon-based, an iron-aluminum-silicon-based, an iron-nickel-based, or an iron-based amorphous powder (hereinafter, referred to as a dust core), and an Mn-based ferrite magnetic core or an Ni-based ferrite magnetic core obtained by sintering a magnetic powder mainly made of iron oxide (hereinafter, referred to as a ferrite core).

As the core 72, a dust core made of the above-described various magnetic materials may be preferably used. The dust core is sold and provided in a form obtained by performing high-pressure molding on a powder in a mold using a press molding method, thermally treating the resulting material to ensure desired magnetic characteristics, and coating the surface with epoxy resin or the like using a powder coating method or an application method. These processes are performed in order to provide electric insulation properties and environment-resistant characteristics and to increase the mechanical strength.

The resin coating processing is an operation with very poor efficiency because application and drying have to be repeated a plurality of times in order to reliably ensure the film thickness, and, furthermore, the shapes vary due to poor appearance dimensional accuracy in the state of completion, and, thus, it is very difficult to directly arrange an engagement member, a positioning member, and a rotation preventing member on a resin coat.

On the other hand, a dust core before coating has high dimensional accuracy in the state of completion because it is manufactured in a mold, and, furthermore, has high degree of freedom in design. For example, the core main body 70 can be obtained by precisely performing insert-molding on a dust core as the core 72, with insulating resin 73 using an injection molding method, and, thus, it is possible to efficiently mold at a time an engagement member, a positioning member, and a rotation preventing member.

It can be assured that the dust core is a magnetic substance more preferable than the silicon steel core or the ferrite core because its change in magnetic characteristics due to an injection pressure applied in the injection molding method is smaller.

As shown in FIG. 7, examples of the shape of the core main body 70 include a tear-drop shape in which ends on one side of two straight portions are connected substantially at a right angle along a bent portion having a small radius of curvature and ends on the other side are linked to each other along an arc portion having a large radius of curvature. Examples of the shape of the core main body 70 may further include substantially rectangular ring shapes, substantially circular, elliptical, or other ring shapes, and ring shapes obtained by combining these.

The cross-section of the core main body 70 preferably has a substantially rectangular shape, a circular shape, or a shape obtained by combining these.

The gap 71 formed through the core main body 70 may be formed by cutting the core main body 70 with a grindstone or the like. At that time, if the core main body 70 is insert-molded with insulating resin 73 using an injection molding method, the core 72 and the insulating resin 73 are closely fixed to each other, and, thus, in the case of using a silicon steel core as the core 72, a burr can be prevented from occurring during cutting, in the case of using a dust core, the molded shape of the dust core can be effectively prevented from being deformed during cutting, and, in the case of using a ferrite core, corner portions and end faces thereof can be prevented from being chipped off.

In conventional techniques, a gap is formed regardless of the magnetic substance of the core 72, and an insulating molded case (not shown) provided with a groove where the gap 71 prepared in advance is open has to be firmly secured and assembled using an adhesive, whereas, in the insert-molding using the injection molding method, a close contact structure can be obtained without an adhesive, and, thus, the processing can be made significantly simple and precise.

Furthermore, the filling member 85 is fitted into the gap 71 of the core main body 70. At the time of fitting, an engagement catch piece 86 of the filling member 85 is engaged with an engagement target member 83 of the core main body 70, so that the filling member 85 is fixed to the core main body 70. The engagement target member 83 may be an engagement target catch piece.

If the core main body 70 has a straight portion in order to allow the air core coil 90 to be easily fitted, the core main body 70 is preferably formed such that one end face 74 of the gap 71 is continuous to an inner face of the straight portion. Furthermore, if the core main body 70 has, for example, a circular or elliptical ring shape with no straight portion, the core main body 70 is preferably formed such that the end face 74 of the gap 71 conforms to or substantially conforms to a tangent line of an inner face of the core main body 70.

The core main body 70 includes a positioning portion 75 for positioning on the holding member 20, and a rotation preventing portion 76 for preventing rotation of the core main body 70 while the air core coil 90 is being fitted, both of which will be described later. The positioning portion 75 may be formed as a positioning shaft projecting upward and downward from a projecting piece 77 that is projecting inward from the inner face of the core main body 70. Furthermore, the rotation preventing portion 76 may be formed as a positioning projecting piece projecting outward from a trailing end 80 that is on the side opposite from an end portion 79 to which the air core coil 90 is fitted.

Figure 4:
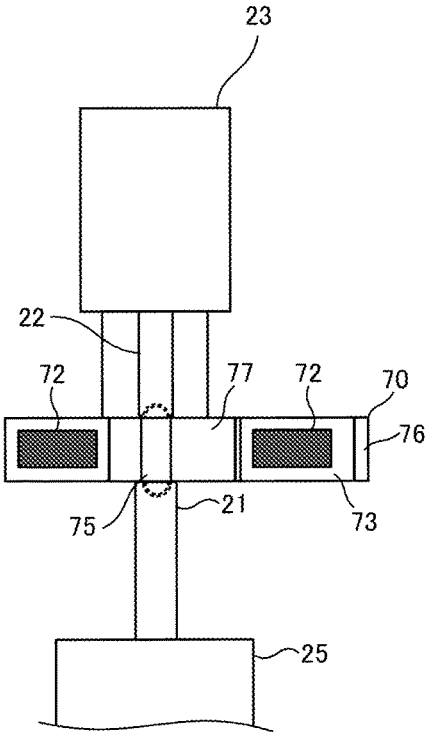
FIG. 4 is a cross-sectional view taken along the line 4-4 in FIG. 3.

The thus configured core main body 70 is attached to the holding member 20. As shown in FIGS. 2 and 4, the holding member 20 may hold the positioning portion 75 of the core main body 70 from above and below. FIG. 4 is a cross-sectional view taken along the line 4-4 in FIG. 3. The holding member 20 is such that the positioning portion 75 is fitted to a lower shaft member 21 projecting from below, and a vertically movable upper shaft member 22 is lowered, so that the positioning portion 75 is held. The lower shaft member 21 is supported on a support base 25. The upper shaft member 22 can be vertically moved by a cylinder 23. Accordingly, the upper shaft member 22 and the lower shaft member 21 form a chuck for holding the positioning portion 75.

At that time, the rotation preventing portion 76 is engaged with a rotation preventing member 24 forming the holding member 20. Examples of the rotation preventing member 24 may include an engagement catch that is disposed away by a predetermined distance from the holding member 20 such that, when the core main body 70 is attached to the holding member 20, the engagement catch is caught on the rotation preventing portion 76. The engagement catch (the rotation preventing member 24) is formed at a front end of a rotation preventing rod 15.

Furthermore, the sending member 50 adopted to pull the air core coil 90 onto the core main body 70 is disposed at the circumferential edge of the holding member 20. As shown in FIG. 3, the sending member 50 may include a plurality of catch pieces 51 biased by springs toward the core main body 70. The catch pieces 51 can move back and forth along the circumferential edge of the core main body 70 in a state of being biased by biasing member 54 so as to project toward the air core coil 90 fitted onto the core main body 70.

Each front end of the catch pieces 51 is configured by a biasing face 55 that is substantially perpendicular to the circumferential edge of the air core coil 90 (the core main body 70), on the downstream side in the pulling direction of the air core coil 90, and a contact face 56 that is at an acute angle to the circumferential edge of the air core coil 90 (the core main body 70), on the upstream side.

Examples of the biasing member 54 include a plunger that has a thread groove on the circumferential face thereof so as to realize stroke adjustment and that can exhibit a spring force, wherein the front end of a piston rod is in contact with the catch piece 51. The catch pieces 51 and the biasing member 54 are attached to a wire rope 52 disposed at the circumferential edge of the air core coil 90. The wire rope 52 is a circular arc member and is supported on a rotation base 57. The rotation base 57 swings about a rotational shaft (not shown) by a wire rope driving member 53 such as a stepping motor. Thus, the wire rope 52 and the catch pieces 51 move back and forth in circumferential directions along the circumferential edge of the air core coil 90 between a sending start position and a sending end position, which will be described later. Accordingly, the wire rope 52, the rotation base 57, and the wire rope driving member 53 are configured as a moving member for the catch pieces 51.

Although three catch pieces 51 are arranged in this embodiment, the number of catch pieces 51 is plural and is not particularly limited to three.

Figure 8:
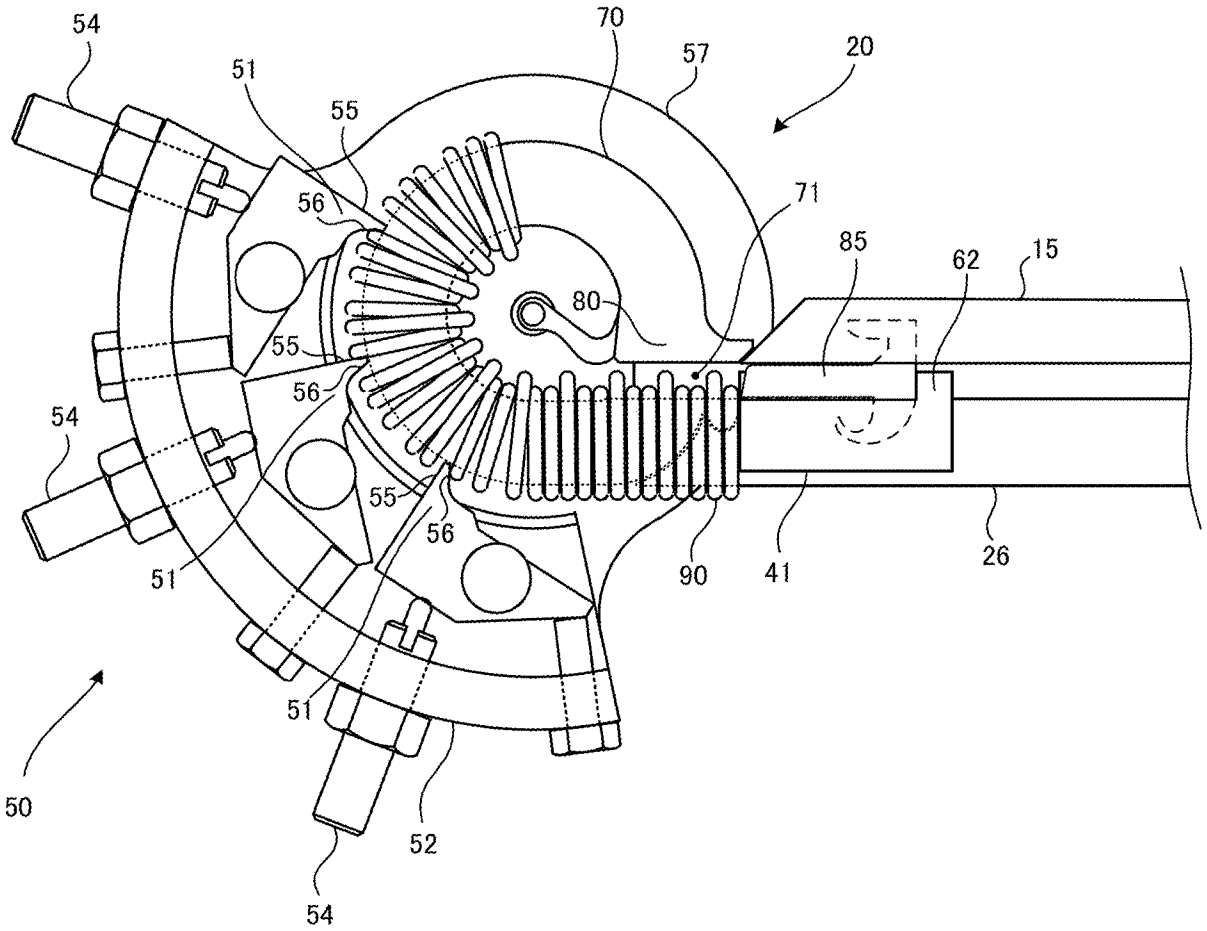
FIG. 8 is an explanatory view illustrating a fitting operation of the air core coil and a filling member.

As shown in FIG. 8, when each of the catch pieces 51 moves from the sending start position to the sending end position (in the pulling direction), the biasing face 55 is brought into contact with the air core coil 90 and moves (pulls) the air core coil 90 along the circumferential edge of the core main body 70. The contact face 56 is in contact with the air core coil 90 pushed by the pushing member 40 when the catch piece 51 has stopped at the sending start position or the like. With this contact, the catch piece 51 is pushed up in a direction away from the air core coil 90 (the core main body 70) resisting the biasing force. That is to say, the air core coil 90 passes by the catch pieces 51 while pushing up the catch pieces 51 so as to be fitted onto the core main body 70, for example, when the catch pieces 51 are stopping.

Figure 5:
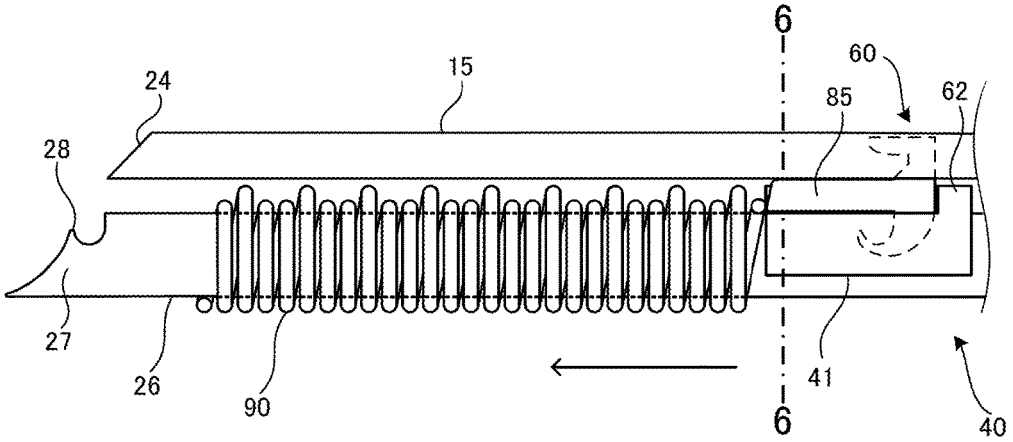
FIG. 5 is an enlarged plan view of an encircled portion 5 in FIG. 1, showing a state in which the air core coil is attached.
Figure 6:
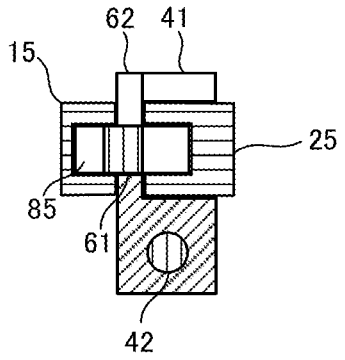
FIG. 6 is a cross-sectional view taken along the line 6-6 in FIG. 5.

As shown in FIGS. 5 and 6, the coil fitting rod 26 on which the air core coil 90 is fitted is an elongated member having a cross-section in the shape of a sideway U. FIG. 5 is an enlarged plan view of an encircled portion 5 in FIG. 1, showing a state in which the air core coil is attached. FIG. 6 is a cross-sectional view taken along the line 6-6 in FIG. 5. The coil fitting rod 26 guides movement of the air core coil 90 fitted thereon. Furthermore, the coil fitting rod 26 has a front end portion 27 that can be engaged with the core main body 70 and can form a substantially straight line with the fitting-side end portion 79 of the core main body 70. The front end portion 27 has an engagement member 28 such as an engagement catch piece that can be engaged with the engagement target member 83 of the fitting-side end portion 79.

As shown in FIG. 1, the coil fitting rod 26 has a base end that is supported in plane by a rotational shaft 29, and the front end portion 27 moves back and forth along an arc locus about the rotational shaft 29 by the rod driving member 30 such as a stepping motor. That is to say, the coil fitting rod 26 of this embodiment swings between a fitting position and a pushing position.

The fitting position is a position at which the front end portion 27 of the coil fitting rod 26 is away from the core main body 70 (the holding member 20) as shown in the broken line in FIG. 1. At this fitting position, an operator performs an operation that fits the air core coil 90 to a predetermined position on the coil fitting rod 26. The pushing position is a position at which the engagement member 28 of the front end portion 27 is engaged with the engagement target member 83 of the fitting-side end portion 79, and the coil fitting rod 26 forms a substantially straight line with the fitting-side end portion 79 of the core main body 70, as described above. At the pushing position, the pushing member 40 pushes the air core coil 90 toward the core main body 70. The fitting position may be any position as long as the air core coil 90 can be fitted.

The pushing member 40 may have a ball screw-type configuration in which, as shown in FIGS. 5 and 6, a pressing member 41 that is an inverted sideway U-shaped elongated member that is fitted onto the coil fitting rod 26 at the fitting position, a screw 42 that is screwed into a screw hole formed below the pressing member 41, and a pressing member driving member 43 such as a stepping motor for rotating the screw 42 are arranged. The screw 42 is supported by the main body of the apparatus 10. As necessary, a driving member (not shown) using a linear motor may be used.

If the screw 42 is rotated forward by the pressing member driving member 43, the pressing member 41 is moved by a screwing force in a direction (pushing direction) closer to the core main body 70 along the coil fitting rod 26. Accordingly, the air core coil 90 is pushed by the pressing member 41 so as to be moved along the coil fitting rod 26, and is fitted onto the core main body 70. The pressing member 41 of this embodiment moves from a reference position shown in FIG. 1 in the pushing direction to a first stop position shown in FIG. 8 and a second stop position shown in FIG. 10. On the other hand, if the screw 42 is rotated in reverse by the pressing member driving member 43, the pressing member 41 is moved by a screwing force in a direction away from the core main body 70. Accordingly, the pressing member 41 that has been moved in the pushing direction returns to the reference position.

Furthermore, the pressing member 41 is provided with a filling member supporting portion 61 and a filling member pressing member 62 forming the filling member fitting member 60. The filling member supporting portion 61 supports the filling member 85. The filling member pressing member 62 pushes (fits) the filling member 85 into the gap 71 of the core main body 70 in accordance with movement of the pressing member 41 in the pushing direction. During movement of the pressing member 41 in the pushing direction, the coil fitting rod 26 and the inner circumferential face of the rotation preventing rod 15 guide movement of the filling member 85. Note that the filling member 85 can be attached to the filling member supporting portion 61 when the coil fitting rod 26 is at the fitting position.

Figure 9:
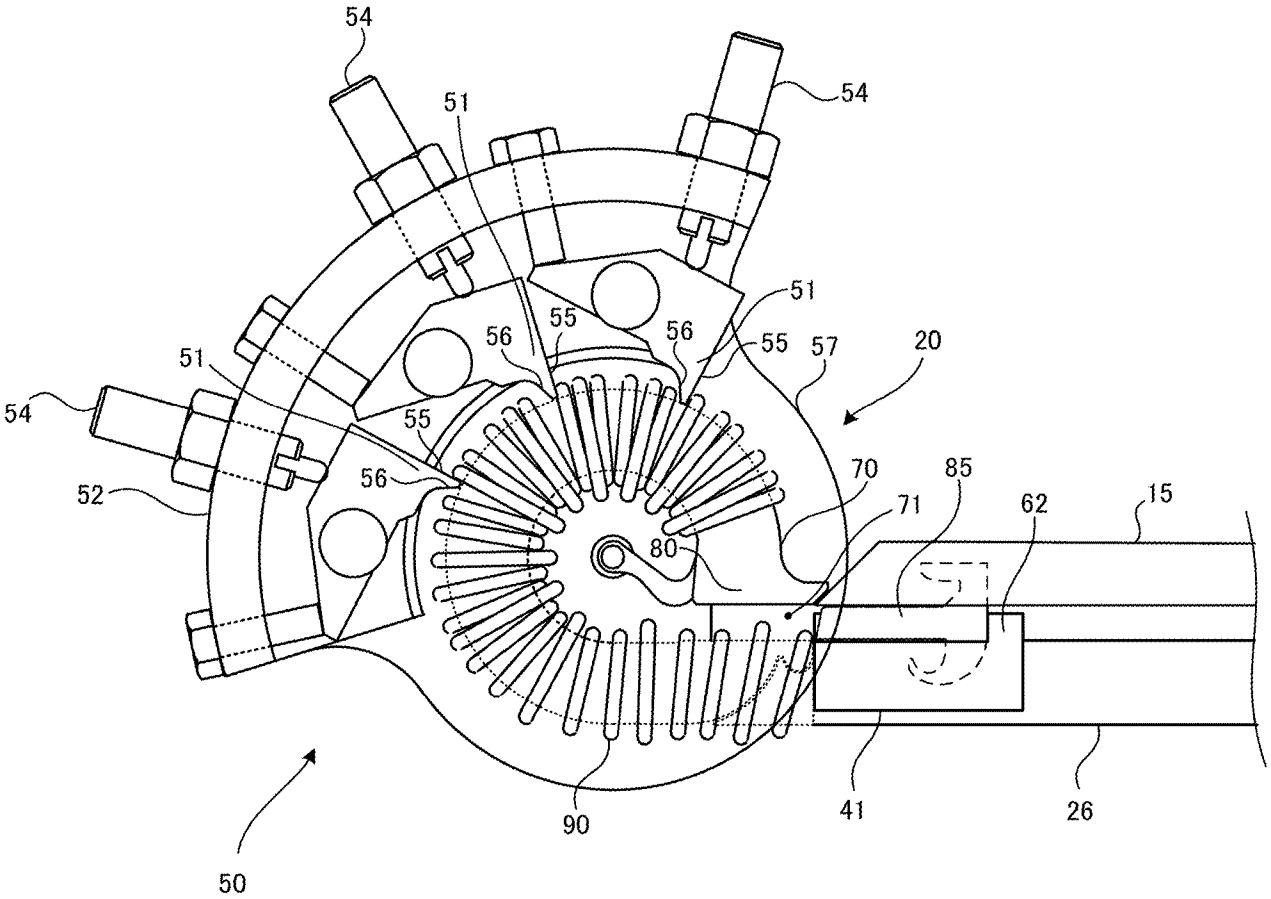
FIG. 9 is an explanatory view illustrating a fitting operation of the air core coil and the filling member.
Figure 10:
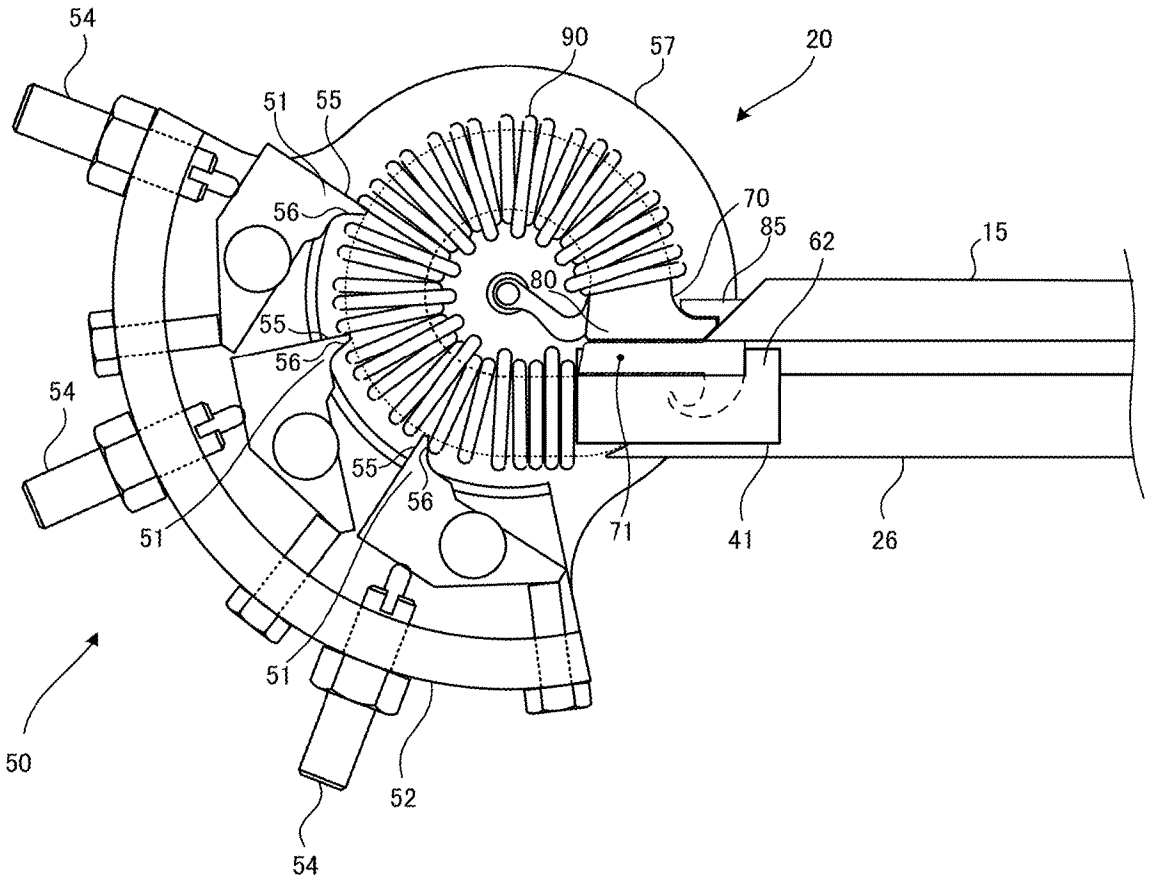
FIG. 10 is an explanatory view illustrating a fitting operation of the air core coil and the filling member.

Next, an operation in which the air core coil 90 fitted on the coil fitting rod 26 is fitted onto the core main body 70 held by the holding member 20 and the filling member 85 is fitted will be described with reference to FIGS. 3 and 8 to 10. FIGS. 8 to 10 are explanatory views illustrating a fitting operation of the air core coil 90 and the filling member 85.

In the fitting operation of the air core coil fitting apparatus 10, first, an operator fits the air core coil 90 onto the coil fitting rod 26 at the fitting position and attaches the core main body 70 to the holding member 20. Next, the operator fits the filling member 85 to the filling member supporting portion 61. The operation is started when the operator presses a start button (not shown).

If the start button is pressed, the upper shaft member 22 of the holding member 20 is lowered and holds the positioning portion 75 of the core main body 70. Furthermore, the coil fitting rod 26 is moved to the pushing position, and the engagement member 28 of the front end portion 27 is engaged with the engagement target member 83 of the fitting-side end portion 79. That is to say, the state is as shown in FIGS. 3 and 4. Then, the pressing member 41 starts to move in the pushing direction. In accordance with the movement of the pressing member 41, the air core coil 90 is fitted onto the core main body 70 while moving along the coil fitting rod 26. At that time, as described above, the air core coil 90 is fitted onto the core main body 70 while being brought into contact with the contact faces 56 and pushing up the catch pieces 51. Subsequently, the pressing member 41 temporarily stops when reaching the first stop position shown in FIG. 8.

Subsequently, the wire rope 52 of the sending member 50 starts to move from the sending start position shown in FIG. 8, toward the trailing end 80 of the core main body 70 (in the pulling direction), to the sending end position shown in FIG. 9. As described above, in accordance with this movement, the biasing faces 55 of the respective catch pieces 51 are brought into contact with the circumferential edge of the air core coil 90. Accordingly, the air core coil 90 is further fitted toward the trailing end of the core main body 70. Then, the wire rope 52 temporarily stops when reaching the sending end position.

During the above-described movement of the wire rope 52, the pressing member 41 has stopped at the first stop position. Accordingly, the trailing end of the air core coil 90 does not return toward the coil fitting rod 26 over the pressing member 41. Furthermore, when the pressing member 41 that has stopped is in contact with the trailing end of the air core coil 90 as shown in FIG. 8, an elastic force in the pulling direction is generated in the air core coil 90 itself, and, thus, the above-described operation in which the catch pieces 51 send the air core coil 90 can be more efficiently performed.

Subsequently, when the wire rope 52 has stopped at the sending end position, the pressing member 41 that is stopping at the first stop position shown in FIG. 9 starts to move again toward the second stop position shown in FIG. 10. That is to say, the operation in which the pressing member 41 pushes the air core coil 90 is started again. Then, the pressing member 41 temporarily stops when reaching the second stop position.

Furthermore, if the pressing member 41 reaches the second stop position, as described above, the filling member 85 is fitted into the gap 71 in a state where the engagement target member 83 is engaged with the engagement catch piece 86.

Subsequently, the wire rope 52 that has stopped at the sending end position returns to the sending start position. At that time, the air core coil 90 is brought into contact with the contact faces 56, and the catch pieces 51 are pushed up in a direction away from the air core coil 90 resisting the biasing force and pass by the air core coil 90. Note that, while the wire rope 52 is returning to the sending start position, the pressing member 41 is stopping at the second stop position.

After the wire rope 52 returns to the sending start position, the pressing member 41 at the second stop position returns to the first stop position. Subsequently, the movement of the wire rope 52 to the sending end position and the movement of the pressing member 41 to the second stop position described above are sequentially performed again. Subsequently, the fitting operation of the air core coil fitting apparatus 10 is ended. That is to say, the fitting operations of the air core coil 90 and the filling member 85 are simultaneously completed.

In this embodiment, the air core coil fitting apparatus 10 performs both fitting operations of the air core coil 90 and the filling member 85, but it is sufficient that at least the fitting operation of the air core coil 90 is performed, and the fitting operation of the filling member 85 may be performed in another step.

The pressing member 41 and the wire rope 52 may be moved to each movement position using a position detecting member (not shown) such as a photosensor. Furthermore, the driving member may be controlled using a control member such as a microcomputer.

As described above, the air core coil fitting apparatus 10 having the pushing member 40 and the sending member 50 can automatically fit the air core coil 90 onto the core main body 70.

Furthermore, since the air core coil 90 can be pulled along the circumferential edge of the core main body 70 using the sending member 50, the air core coil 90 that is being fitted onto the core main body 70 is fitted to the trailing end 80 of the core main body 70 without being stuck at the middle of the core main body 70. Moreover, since a plurality of catch pieces 51 are used, a force in the pulling direction can be applied to the air core coil 90 at a plurality of positions, and, thus, a situation can be prevented in which part of the air core coil 90 is tensioned and deformed.

The description of the foregoing embodiment is for describing the present invention, and should not be interpreted as limiting or restricting the scope of claims of the present invention. Furthermore, it goes without saying that the configurations of the constituent elements of the present invention are not limited to those in the embodiment, and that various modifications are possible within the technical scope of the claims.

For example, in this embodiment, the pushing member 40 (the pressing member 41) and the sending member 50 (the wire rope 52) are operated in a predetermined order a predetermined number of times, but there is no particular limitation to this. The pushing member 40 and the sending member 50 may be simultaneously operated, or each of the pushing member 40 and the sending member 50 may be operated only once.

Furthermore, the stop position of the pressing member 41 and the sending start position and the sending end position of the wire rope 52 are not particularly limited to those described above, and may be adjusted as appropriate according to the shape of the core main body 70, the material of the air core coil 90, and the like.

Furthermore, in the foregoing embodiment, the coil fitting rod 26 is swung about the rotational shaft 29 between the fitting position and the pushing position, but there is no particular limitation to this. For example, the coil fitting rod 26 may be moved in parallel to the direction along the longitudinal direction of the coil fitting rod 26, or may be detachably attached such that a magazine replacement is possible.

Furthermore, in this embodiment, the wire rope 52 on which the catch pieces 51 are arranged is disposed close to the outer circumferential edge of the core main body 70, but there is no particular limitation to this. For example, if the core main body 70 has a relatively large inner diameter, the wire rope 52 may be disposed close to the inner circumferential edge of the core main body. In this case, the wire rope 52 may be moved along the inner circumferential edge of the core main body.

Furthermore, the wire rope 52 on which the catch pieces 51 are arranged as the sending member for the air core coil is used as the biasing member, but, in the case of a thin copper wire having a coil copper wire diameter of about 1.0 mm or less, the biasing member may be such that a toothed transmission belt (timing belt) is placed around a pulley so as to be pressed against the air core coil.

What is claimed is:

1. An air core coil fitting apparatus, comprising:

a holding member adopted to hold a core main body that is formed in a ring shape, has a gap extending through the core main body from an inner circumferential face to an outer circumferential face thereof, and allows an air core coil wound in advance to be fitted onto the core main body from one end thereof;

a coil fitting rod on which the air core coil that is to be fitted onto the core main body held by the holding member is fitted;

a rod driving member adopted to bring a front end of the coil fitting rod close to or into contact with the one end of the core main body held by the holding member;

a pushing member adopted to push the air core coil fitted on the coil fitting rod, toward the one end of the core main body, in a state in which the front end of the coil fitting rod is close to or in contact with the one end of the core main body; and a sending member adopted to pull the air core coil pushed by the pushing member and fitted onto the core main body, toward another end of the core main body, the sending member being disposed at a circumferential edge of the core main body held by the holding member.

2. The air core coil fitting apparatus according to claim 1, wherein the rod driving member wings the coil fitting rod, thereby bringing the front end of the coil fitting rod close to or into contact with the one end of the core main body held by the holding member.

3. The air core coil fitting apparatus according to claim 1, wherein the rod driving member moves the coil fitting rod in a direction along a longitudinal direction of the coil fitting rod, thereby bringing the front end of the coil fitting rod close to or into contact with the one end of the core main body held by the holding member.

4. The air core coil fitting apparatus according to claim 1, wherein the sending member is disposed close to an outer circumferential edge of the core main body held by the holding member, and includes a plurality of catch pieces that can project toward and withdraw from the outer circumferential edge and a moving member that moves the catch pieces from the one end to the other end of the core main body.

5. The air core coil fitting apparatus according to claim 4, wherein the pushing member pushes the air core coil toward the core main body at least to a position facing the plurality of catch pieces, and the sending member has a biasing member adopted to bias the plurality of catch pieces toward the outer circumferential edge, thereby bringing the plurality of catch pieces into contact with the air core coil.

6. The air core coil fitting apparatus according to claim 5, wherein each of the plurality of catch pieces has a biasing face for biasing the air core coil in contact with the catch piece in a direction along the outer circumference during movement from the one end to the other end of the core main body.

7. The air core coil fitting apparatus according to claim 4, wherein the moving member has a circular arc member that is disposed close to the outer circumferential edge of the core main body held by the holding member and travels from the one end to the other end of the core main body.

8. The air core coil fitting apparatus according to claim 1, wherein the coil fitting rod includes, at the front end thereof, an engagement member that can be engaged with the one end of the core main body held by the holding member.

9. The air core coil fitting apparatus according to claim 8, wherein the core main body includes a core made of a magnetic material and an insulating coating member that coats an outer circumference of the core, and the coating member includes an engagement target member that can be engaged with the engagement member.

10. The air core coil fitting apparatus according to claim 1, wherein the core main body includes a core made of a magnetic material and an insulating coating member that coats an outer circumference of the core, and the coating member includes a positioning member projecting from an inner circumference at the other end of the core main body, and the holding member includes a chuck for holding the positioning member.

11. The air core coil fitting apparatus according to claim 1, wherein the core main body includes a core made of a magnetic material and an insulating coating member that coats an outer circumference of the core, and the coating member includes a rotation preventing member projecting from an outer circumference at the other end of the core main body, and the holding member includes a pressing member for biasing the rotation preventing member in an orientation opposite to a fitting direction of the air core coil.

12. The air core coil fitting apparatus according to claim 9, wherein the core is a dust core, and the coating member is formed by performing insert-molding with an insulating resin material using an injection molding method.

13. The air core coil fitting apparatus according to claim 10, wherein the core is a dust core, and the coating member is formed by performing insert-molding with an insulating resin material using an injection molding method.

14. The air core coil fitting apparatus according to claim 11, wherein the core is a dust core, and the coating member is formed by performing insert-molding with an insulating resin material using an injection molding method.

* * * * *